United States Patent [19]

Bruhn et al.

[11] 4,279,541

[45] Jul. 21, 1981

[54] STOP END PIECE PARTICULARLY FOR GUTTERS

[75] Inventors: Peter E. Bruhn, Odder; Finn U. H. Jensen, Skanderborg, both of Denmark

[73] Assignee: Lindab Platisol AB, Bastad, Sweden

[21] Appl. No.: 44,187

[22] Filed: May 31, 1979

[30] Foreign Application Priority Data

Jun. 5, 1978 [SE] Sweden ..... 7806560

[51] Int. Cl.[3] ..... E04D 13/00

[52] U.S. Cl. ..... 405/119; 52/11

[58] Field of Search ..... 52/11–16; 210/162; 220/315, 306, 352, 354, 355, 356; 405/119; 285/DIG. 2, DIG. 22; 229/45

[56] References Cited

U.S. PATENT DOCUMENTS

| | | | |
|---|---|---|---|
| 1,373,883 | 4/1921 | Gray | 405/119 |
| 1,948,920 | 2/1934 | Johnson | 220/355 |
| 3,190,537 | 6/1965 | Meinecke | 229/45 |
| 3,679,088 | 7/1972 | Swett | 220/354 |

FOREIGN PATENT DOCUMENTS

| | | | |
|---|---|---|---|
| 283601 | 12/1965 | Australia | 52/11 |

*Primary Examiner*—John E. Murtagh

*Attorney, Agent, or Firm*—Weingarten, Maxham & Schurgin

[57] ABSTRACT

A stop end piece for closing particularly gutters, comprises a plate having a peripheral channel which is formed by the bent peripheral edge of the plate and a portion extending along said edge, which portion protrudes from the plane of the plate in the same direction as said peripheral edge. The peripheral edge has teeth which extend across the channel obliquely towards said portion and bear against or terminate at a small distance from the boundary surface of said portion, which faces said peripheral edge. The end of the gutter to be closed can be pressed into the channel, the teeth urging the inner side of the gutter wall into snug engagement with said boundary surface and simultaneously preventing withdrawal of the gutter end from the channel by their engagement in the outer side of the end of the gutter.

3 Claims, 4 Drawing Figures

STOP END PIECE PARTICULARLY FOR GUTTERS

This invention relates to a stop end piece particularly for gutters comprising a plate which along its periphery has an edge bent substantially at right angles thereto and which along at least part of the bent peripheral edge has a portion protruding from the plane of the plate in the same direction as the peripheral edge and defining together with said peripheral edge a channel into which the end of the gutter is introducible.

A stop end piece for gutters normally comprises a semicircular plate which is soldered or glued to the gutter so that a watertight closure thereof is obtained. Stop end pieces have also been suggested for gutters made from surface treated sheet metal, said end pieces providing the watertight closure of the gutter by means of gaskets. in this case the stop end piece is so designed that the edge of the end piece engages the gutter over but a small part of the length thereof, the gasket producing a frictional force between the end piece and the gutter. The stop end piece is retained in position merely by frictional force without any particular adhesives.

The first-mentioned, original design of the stop end piece requires the use of solder or glue, and the work must be done with great accuracy and preferably by an expert in order that a stable and watertight closure of the gutter shall be realized. The embodiment of the stop end piece including a gasket is expensive to manufacture and moreover necessitates a special form of the end of the gutter. In this case, too, the services of an expert must be engaged for the work of closing the gutter at the ends.

One object of the present invention is to provide a simplified stop end piece by means of which a durable and satisfactorily watertight closure of the gutter can be realized without the use of either solder, adhesive or gaskets.

Another object of the invention is to facilitate mounting so that no expert knowledge is required for that purpose. Moreover, the stop end piece shall permit being manufactured at a very low price.

To these ends, the bent peripheral edge has teeth or flaps bent towards the boundary surface of the arcuate or bent portion, which boundary surface faces the bent edge, said teeth or flaps extending into engagement with or terminating at a distance from said boundary surface which is smaller than the material thickness of the gutter to be closed.

Preferably, the teeth or flaps of a stop end piece designed in this way extend obliquely into the channel towards said boundary surface and are of a length exceeding the width of the channel. Further, the free ends of the teeth or flaps facing said boundary surface are formed with sharp end edges. The plate and its pertaining parts are preferably made in an integral piece, suitably from sheet metal.

For closing a gutter at its ends with the aid of stop end pieces designed in this way each end piece is placed so that the end of the gutter lies at the point where the teeth or flaps are in engagement with or at some distance from the boundary surface of the bent portion, whereupon the stop end piece is simply hammered in position on the end of the gutter with the aid of a tool. The inner surface of the gutter is thus snugly pressed against the boundary surface of the arcuate portion and is retained in this position by means of the flaps on the outer side. Should these be bent obliquely to the boundary surface they also effectively prevent removal of the stop end piece from the end of the gutter by reason of their oblique position and their sharp end edges which are engaged in the outer side of the gutter.

Thus, it is very simple to mount the stop end piece according to the invention, and such mounting can be performed even by unskilled persons. Watertightness is ensured in that the inner side of the gutter snugly bears against the boundary surface of the arcuate or bent portion. In this context, watertightness means that water collecting in the gutter cannot penetrate at the stop end piece but flows away through the downpipe. The teeth or flaps realize not only the above snug engagement because of the constant surface pressure which these can provide, but also prevent removal of the stop end piece, which can only be brought about by exertion of very great forces.

An embodiment of the invention will be described in greater detail below with reference to the accompanying drawings in which FIG. 1 is an elevation of a stop end piece according to the invention as seen from the outer side;

Figure 1:
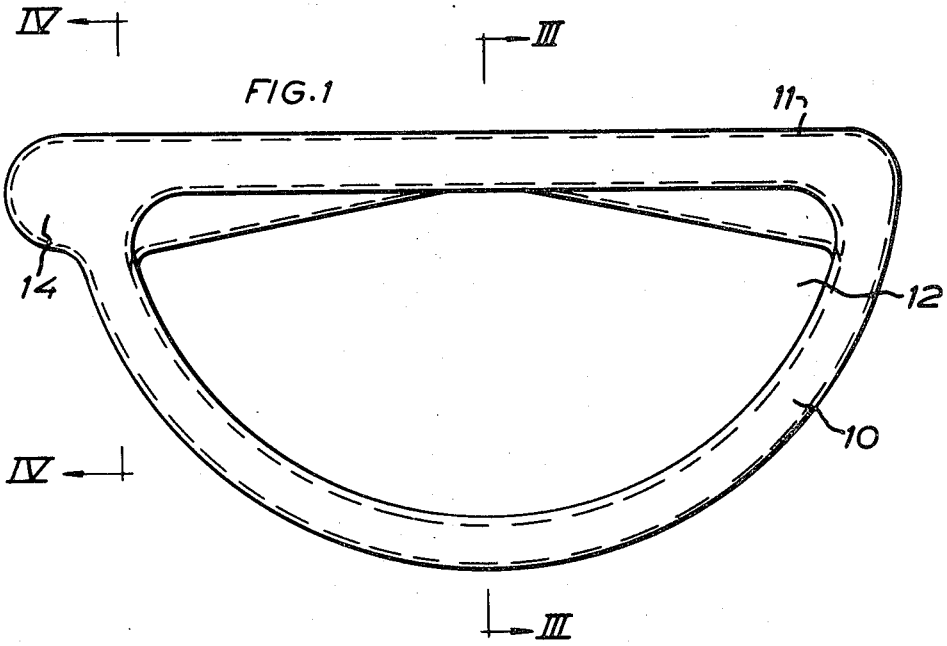
Figure 2:
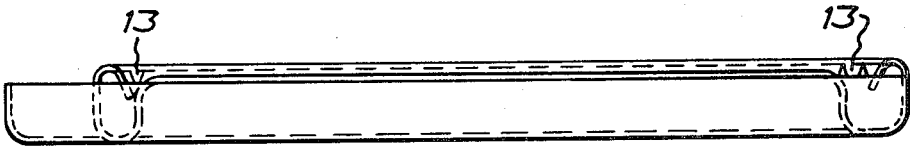
FIG. 2 is a top plan view of the stop end piece in FIG. 1.
Figure 3:
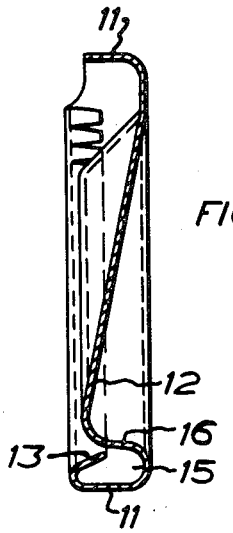
FIG. 3 is a section along line III—III in FIG. 1.
Figure 4:
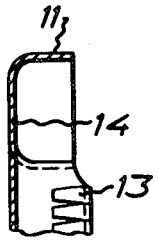
FIG. 4 is a section along line IV—IV in FIG. 1.

In FIG. 1 is shown an approximately semicircular plate 10 of sheet metal which has a peripheral edge 11 bent at right angles throughout its periphery. The plate 10 comprises an arcuate portion 12 which is pressed or drawn out of the plane of the plate 10 in the same direction as the edge 11 and defines with said edge a channel 15 along the arcuate portion of the plate. The portion 12 has a boundary transitional surface 16 which extends over part of the height of said portion approximately in parallel with the bent edge 11 and which smoothly curving merges into the remainder of the portion 12, as will appear more in detail from FIG. 3. The bent edge 11 has teeth 13 integral therewith (FIGS. 2 and 3), which project obliquely into the channel 15 and terminate at a distance from said boundary surface 16 smaller than the thickness of the gutter to be closed. The ends of the teeth or flaps 13 facing the boundary surface 16 may be pointed or, as shown in FIG. 4, have transversely cut-off front ends. These ends preferably have sharp edges.

As will appear from FIG. 1, the stop end piece is not fully symmetrical about the center axis, having on its one side a protruding portion 14 which is to receive the bead of the gutter. To permit this the teeth or flaps 13 terminate at some distance from said portion 14, as will appear from FIG. 4.

When a gutter is to be closed by means of the stop end piece according to this invention, said piece is placed against the end of the gutter, with the wall thereof located at the angle between the wall 16 of the portion 12 and the teeth 13. After that, pressure is exerted on the end piece, e.g. by means of a tool, the inner side of the gutter sliding along the wall 16 of the end piece and the teeth 13 moving along the outer side of the gutter digging slightly into the surface so that a considerable force will be required to remove the end piece, and at the same time the teeth 13 urge the inner side of the wall of the gutter snugly against the boundary wall 16 of the end piece, whereby a liquid-tight joint is obtained.

It is clearly apparent from the above description that an extremely simple stop end piece is provided, which can be manufactured at a low price and besides be mounted by unskilled persons.

What we claim and desire to secure by Letters Patent is:

1. A unitary stop end piece adapted to fit over the end of and permanently close a gutter, said gutter being elongated and having a hollow, generally arcuate cross section, the wall of said gutter extending away from the arcuate edge at the end being closed by said stop end piece being smooth, said wall being thin compared with the radius of curvature of said arcuate cross section, said stop end piece comprising:

a plate;

an edge extending from the periphery of said plate and bent at substantially a right angle with respect to the plane of said plate;

a central portion displaced from the plane of said plate in the direction of said bent edge;

a transitional surface connecting said central portion to said plate along at least a portion of the periphery of said plate and spaced from said bent edge, said transitional surface and said bent edge together defining a channel;

a plurality of teeth extending from said bent edge obliquely into said channel in a direction toward said transitional surface and toward said plate, said teeth terminating a distance from said transitional surface which is less than the thickness of the gutter wall, the end of the gutter to be closed being adapted to be inserted toward said plate into said channel between said transitional surface and said teeth, whereby said teeth bias the smooth gutter wall toward said transitional surface and bite into the surface of the smooth gutter wall thereby forming a permanent liquid-tight joint at the open end of the gutter.

2. A stop end piece as in claim 1, wherein said teeth are formed with sharp end edges.

3. A unitary closure member for the end of an arcuate fluid conductive gutter member, said closure member comprising:

an elongated gutter having a hollow, generally arcuate cross section, the wall of said gutter extending away from the arcuate edge at the end being closed by said closure member being smooth, said wall being thin compared with the radius of curvature of said arcuate cross section;

said closure member comprising:

a plate;

an edge extending from the periphery of said plate and bent at substantially a right angle with respect to the plane of said plate;

a central portion displaced from the plane of said plate in the direction of said bent edge;

a transitional surface connecting said central portion to said plate along at least a portion of the periphery of said plate and spaced from said bent edge, said transitional surface and said bent edge together defining a channel; and a plurality of teeth extending from said bent edge obliquely into said channel in a direction toward said transitional surface and toward said plate, said teeth terminating a distance from said transtional surface which is less than the thickness of said gutter wall, the end of said gutter having a relatively sharp edge formed by transversely cutting through the material thereof, said sharp edge having the generally arcuate shape of said gutter and forming the end to be closed, said sharp edge of said gutter being inserted toward said plate into said channel between said transitional surface and said teeth, whereby said teeth bias the smooth gutter wall toward said transitional surface and bite into the surface of said smooth gutter wall thereby forming a permanent liquid-tight joint at the open end of said gutter.

* * * * *

UNITED STATES PATENT AND TRADEMARK OFFICE

CERTIFICATE OF CORRECTION

PATENT NO. : 4,279,541

DATED : July 21, 1981

INVENTOR(S) : Peter E. Bruhn et al

It is certified that error appears in the above—identified patent and that said Letters Patent is hereby corrected as shown below:

| | | |
|---|---|---|
| Column 2, | line 35, | "boundary transitional" should read --boundary or transitional--. |
| Column 4, | line 25, | "transtional" should read --transitional--. |

Signed and Sealed this

*Fifth* Day of *January 1982*

[SEAL]

*Attest:*

*Attesting Officer*

GERALD J. MOSSINGHOFF

*Commissioner of Patents and Trademarks*